US008323115B2

(12) United States Patent
Hocking

(10) Patent No.: US 8,323,115 B2
(45) Date of Patent: Dec. 4, 2012

(54) DRILLING APPARATUS

(75) Inventor: Monte Hocking, Albury (AU)

(73) Assignee: Montrae Mining Pty. Ltd. (AU)

( * ) Notice: Subject to any disclaimer, the term of this patent is extended or adjusted under 35 U.S.C. 154(b) by 0 days.

(21) Appl. No.: 12/991,049

(22) PCT Filed: May 5, 2009

(86) PCT No.: PCT/AU2009/000552

§ 371 (c)(1),
(2), (4) Date: Feb. 3, 2011

(87) PCT Pub. No.: WO2009/135248

PCT Pub. Date: Nov. 12, 2009

(65) Prior Publication Data

US 2011/0294583 A1 Dec. 1, 2011

(30) Foreign Application Priority Data

May 5, 2008 (AU) ..... 2008902183

(51) Int. Cl.
*E21B 17/07* (2006.01)

(52) U.S. Cl. ..... 464/20

(58) Field of Classification Search ..... 464/18, 464/20, 96, 180, 163, 165; 175/56, 321
See application file for complete search history.

(56) References Cited

U.S. PATENT DOCUMENTS

| | | | | |
|---|---|---|---|---|
| 4,759,738 | A | 7/1988 | Johnson | |
| 6,332,841 | B1 | 12/2001 | Secord | |
| 7,779,932 | B2 * | 8/2010 | Hartung et al. | 464/20 |
| 2010/0025118 | A1 * | 2/2010 | Hampson et al. | 175/321 |

FOREIGN PATENT DOCUMENTS

WO 2009/055412 A2 4/2009

* cited by examiner

*Primary Examiner* — Gregory Binda
*Assistant Examiner* — Josh Skroupa
(74) *Attorney, Agent, or Firm* — Clark Hill PLC

(57) ABSTRACT

A cushion sub-assembly (10) for connection to a drill string to absorb vibrations in the drill string, the cushion sub-assembly (10) including a main body (12) defining a chamber therein (24), a piston member (28) disposed within the chamber (24) capable of axial movement at least partially within the chamber (24) between a first and second position, at least one axially extending piston rod (42) disposed inside a respective axial bore of the piston member (28), the at least one piston rod (42) preventing relative rotation between the piston member (28) and the main body (12) while permitting axial movement of the piston member (28) between the first and second positions, and a vibration absorbing means (44, 46, 48, 50) at opposite ends of the chamber (24) for engagement by the piston member (28) when in either of the first or second positions for absorbing axial vibrations, the configuration of the at least one piston rod (42) inside the piston member (28), and engagement of the piston member (28) with the vibration absorbing means (44, 46, 48, 50) serving to minimize transmission of axial vibrations between the piston member (28) and the main body (12).

15 Claims, 5 Drawing Sheets

DRILLING APPARATUS

This invention relates to a cushion sub-assembly of a type for absorbing vibrations being transmitted to a drill head by a drill pipe during the drilling of a bore hole.

RELATED/PRIORITY APPLICATION

This application is a National Phase filing regarding International Application No. PCT/AU2009/000552, filed on May 5, 2009, which relies upon Australian Application No. 2008902183, filed on May 5, 2008 for priority.

BACKGROUND OF THE INVENTION

It is known to include a cushion sub-assembly below the drill head of a drilling rig and through which the turning force of the drill head is transmitted to the uppermost drill pipe section to thereby rotate the drill string within the bore being drilled. Such cushion sub-assemblies have taken a number of different forms, the design of which takes into account the features of the drilling operation in which the cushion sub-assembly will be used.

For example, it is common in a drilling operation to force the drilling bit into engagement with the bottom of the bore and to achieve the cutting action due to rotational motion only of the drill string and drill bit. A cushion sub-assembly designed for this type of drilling must be capable of absorbing a significant portion of both the torsional and axial vibrations resulting from the cutting action of the bit.

In downhole hammer drilling, compressed fluid is transmitted to a hammer means at the bit location and this results in additional axial vibration. Cushion sub-assemblies used for this type of drilling have therefore needed to be capable of transmitting a drilling torque as well, despite the cushion sub-assembly being primarily designed to prevent the transmission of high axial vibration forces to the drilling head. Existing cushion sub-assemblies are not satisfactory as vibration is still carried through to the rotary head.

A further problem with existing cushion sub-assemblies of this type is their tendency to wear very quickly. The internal components of the cushion sub-assembly, particularly those in contact with the reciprocating piston, require regular maintenance, refurbishment, and eventual replacement. Refurbishment of existing cushion sub-assemblies is time consuming and expensive due to the number of parts requiring maintenance. Accordingly, there is a clear commercial benefit in having a cushion sub-assembly that boasts an increased lifespan, and which is designed to be quick, simple and inexpensive to refurbish.

OBJECTS OF THE INVENTION

It is an object of the present invention to overcome at least some of the above-mentioned problems or provide the public with a useful alternative.

There is a need for a cushion sub-assembly having both axial and torsional vibration absorbing characteristics capable of effectively handling the types of forces experienced in modern drilling techniques.

There is also a need for a cushion sub-assembly having a longer wear life than is otherwise achievable with existing cushion sub arrangements whose design and internal arrangement facilitates quick, simple and inexpensive refurbishment/replacement.

The reference to any prior art in this specification is not, and should not be taken as, an acknowledgement or any form or suggestion that the prior art forms part of the common general knowledge in Australia.

SUMMARY OF THE INVENTION

In one aspect, the present invention provides a cushion sub-assembly for connection to a drill string to absorb vibrations in the drill string, the cushion sub-assembly including a main body defining a chamber therein, a piston member disposed within the chamber capable of axial movement at least partially within the chamber between a first and second position, at least one axially extending piston rod disposed inside a respective axial bore of the piston member, the at least one piston rod preventing relative rotation between the piston member and the main body while permitting axial movement of the piston member between the first and second positions, and a vibration absorbing means at opposite ends of the chamber for engagement by the piston member when in either of the first or second positions for absorbing axial vibrations, the configuration of the at least one piston rod inside the piston member, and engagement of the piston member with the vibration absorbing means serving to minimize transmission of axial vibrations between the piston member and the main body.

In one embodiment, the piston member includes a piston shaft formed integrally therewith, the piston shaft being of a stepped down diameter.

The piston member may further include a plurality of radially disposed respective axial bores extending through the piston member, the bores being disposed between the outer periphery of the piston member and the piston shaft for accommodating a plurality of the piston rods. By including piston rods running inside the piston member, not only has it been found that axial vibration is reduced, but once the cushion sub-assembly has reached the end of its wear life, relatively minimal work is required to refurbish the cushion sub-assembly for re-use. Typically, after prolonged use, the bores extending axially through the piston member become elongated and the piston rods themselves become significantly worn. Thus, in order to refurbish the cushion sub-assembly, the bores need to be bored out and made circular again, and the piston rods require replacement with rods having an appropriately larger diameter. However, in embodiments of the invention, the main body of the cushion sub-assembly does not require refurbishment or replacement because the piston rods are disposed inwards of the casing.

In one embodiment, the main body includes a casing member defining the chamber and a back head mounted to the casing member at an upper end thereof, the back head including a first connection means for rigid connection to a driving portion of the drill string.

In another embodiment, the piston shaft includes a second connection means for rigid connection to a driven portion of the drill string.

Preferably the first position of the piston member corresponds with the upper end of the main body, and the second position of the piston member corresponds with the lower end of the main body.

The vibration absorbing means may be in the form of at least one pad of elastomeric material. Further, the vibration absorbing means at the upper end of the main body may include three pads of elastomeric material, wherein the piston member engages a bottom of the three pads when in the first position. In this embodiment, the lower-most pad of elastomeric material has a first thickness and has a first grade strength, the middle pad has a second thickness which may be substantially equal to the first thickness and a second grade strength which may be substantially greater than the first grade strength, and the upper-most pad of elastomeric material has a third thickness which may be substantially thinner than the first thickness and has a third grade strength which may be substantially greater than the second grade strength.

In another embodiment, the vibration absorbing means at the lower end of the chamber includes a single pad of elastomeric material of high strength, wherein the piston member engages the single pad when in the second position.

BRIEF DESCRIPTION OF THE DRAWINGS

Once or more embodiments of the invention are described below with reference to the accompanying drawings, which are incorporated in and constitute a part of this specification. In the drawings.

Wherever possible, the same reference numbers will be used throughout the drawings and the following description to refer to the same and like parts.

DESCRIPTION OF EMBODIMENTS

Figure 1:
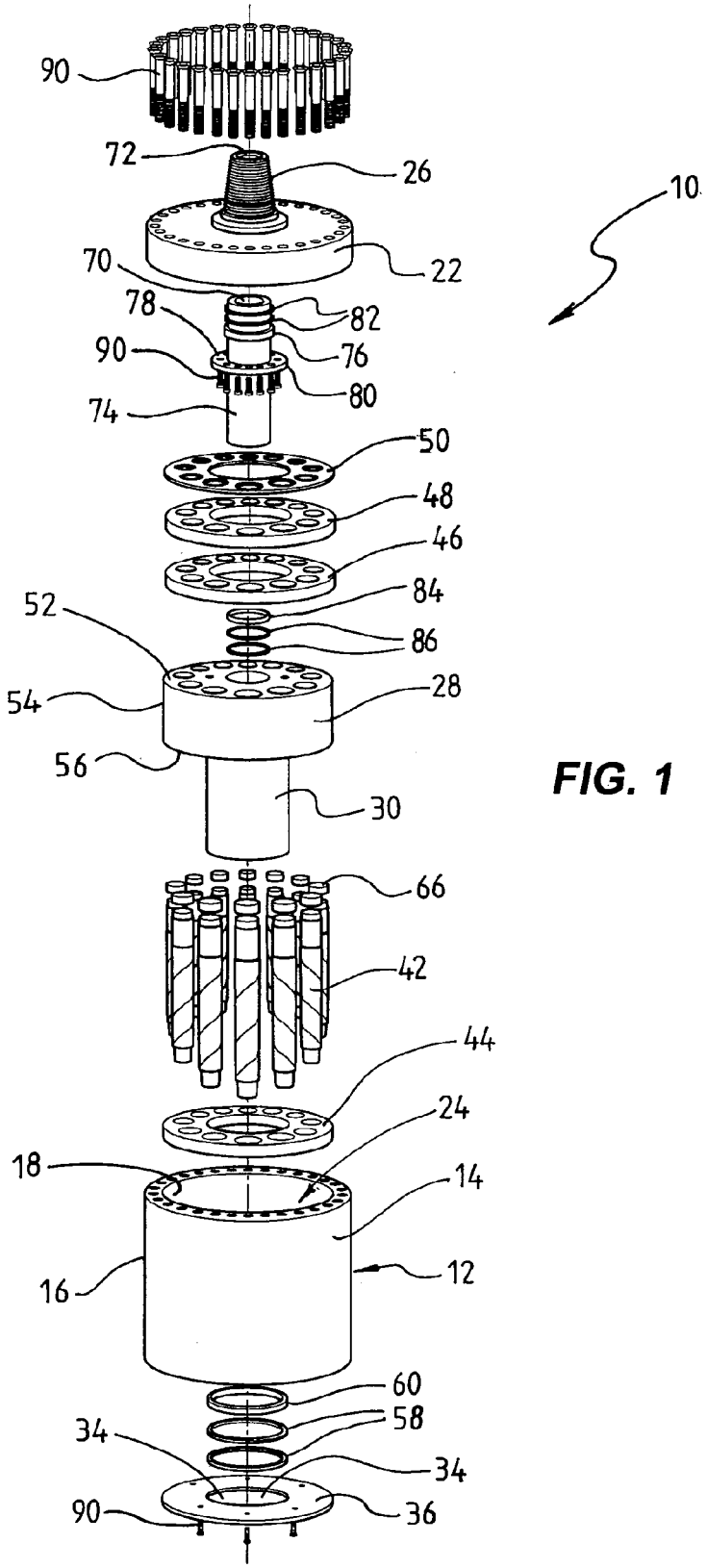
FIG. 1 illustrates an exploded, perspective view of a cushion sub-assembly in accordance with a first embodiment of the present invention.
Figure 2:
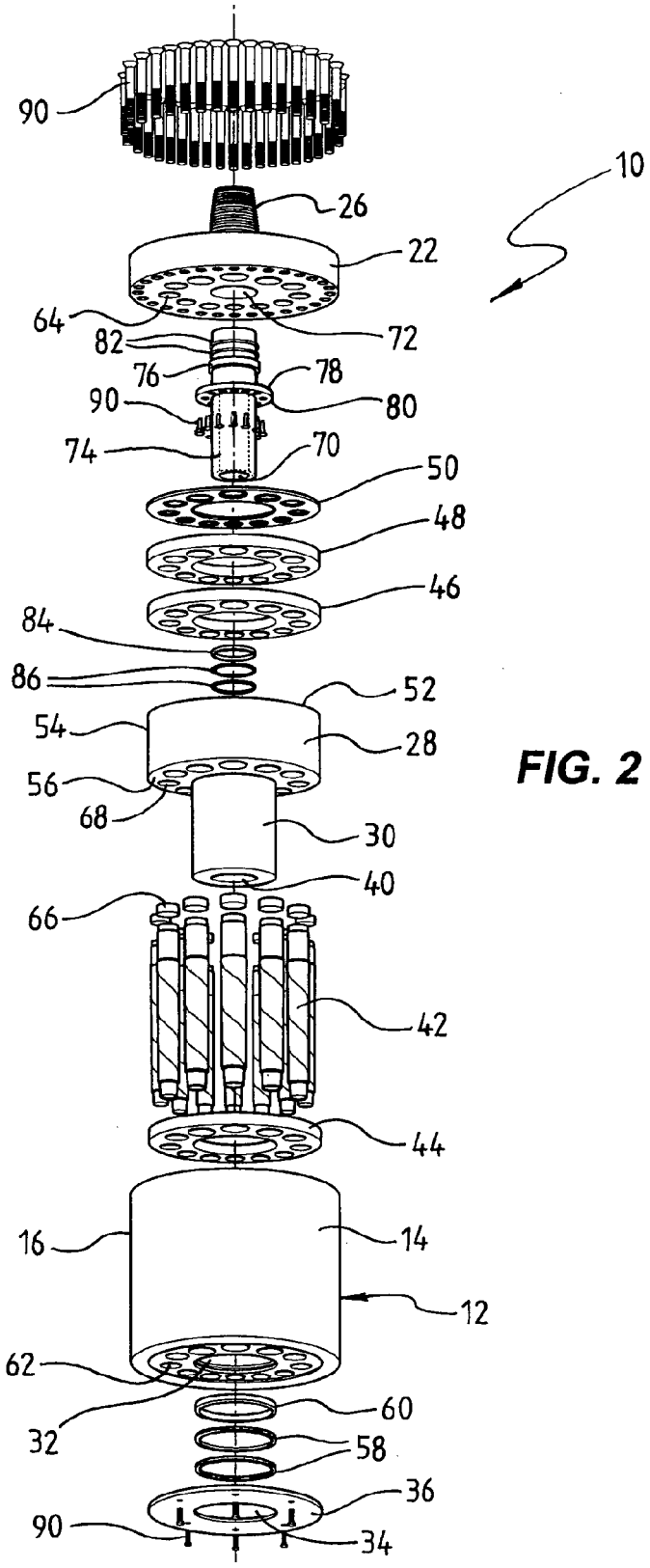
FIG. 2 illustrates an alternate exploded, perspective view of the cushion sub-assembly of FIG. 1.
Figure 3A:
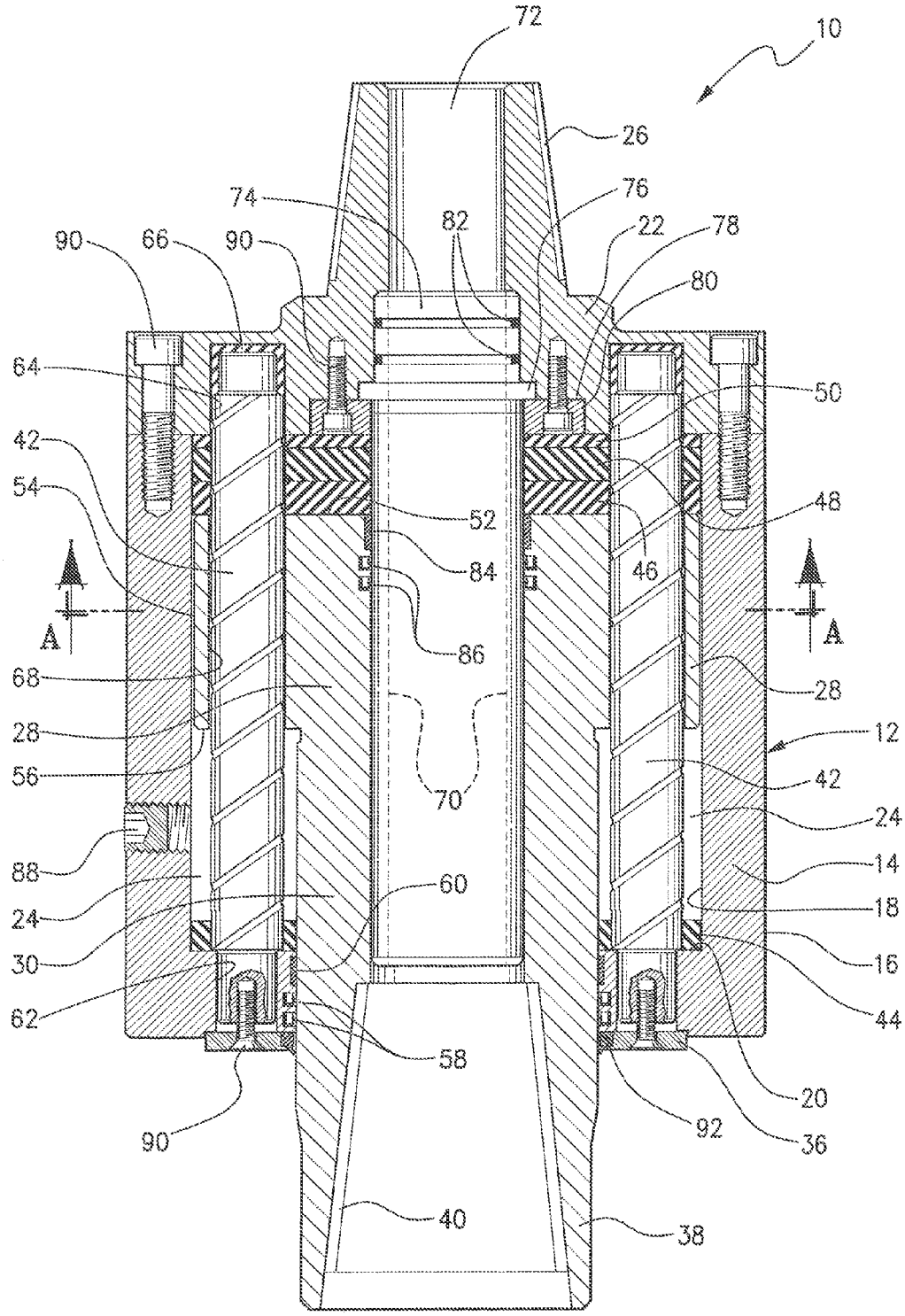
FIG. 3*a* illustrates an axial cross-sectional view of the cushion sub-assembly of FIGS. 1 and 2.
Figure 3B:
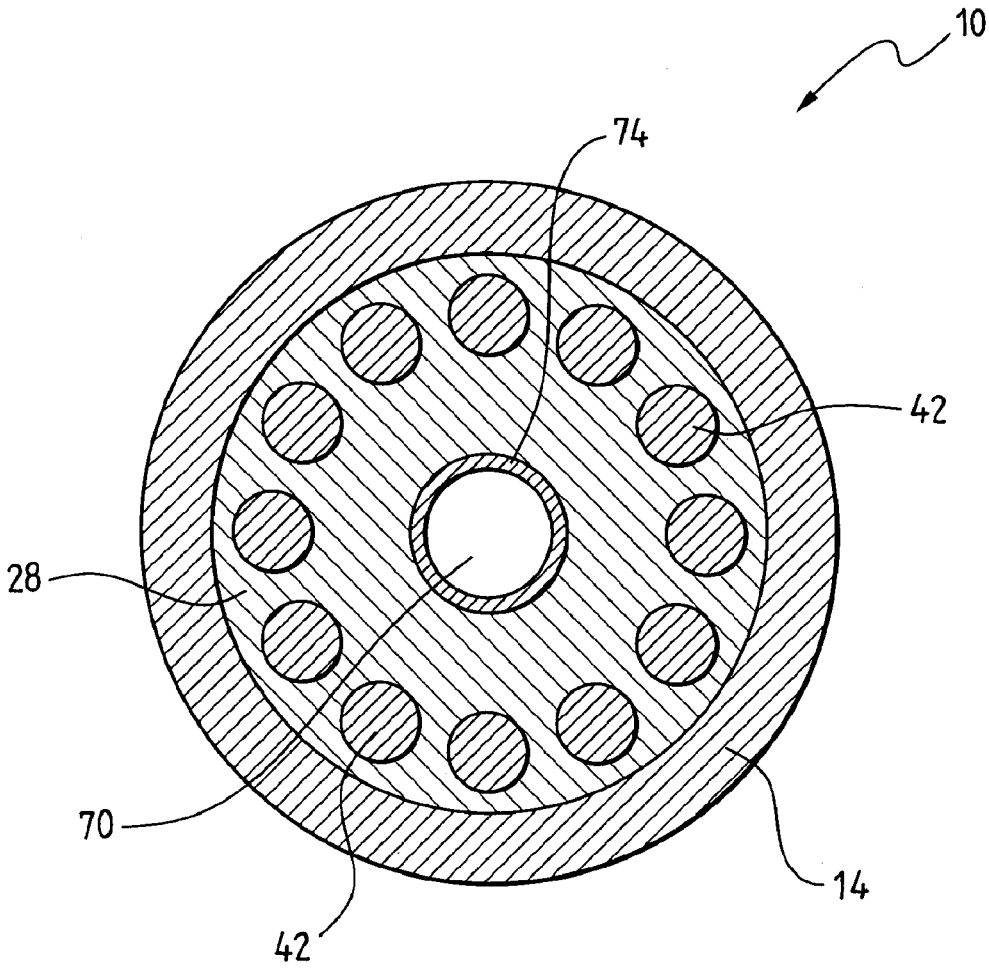
FIG. 3*b* illustrates a cross-sectional view of the cushion sub-assembly of FIGS. 1 and 2, taken along line A-A in FIG. 3*a*.

Referring to the drawings, the cushion sub-assembly is generally denoted by the reference numeral 10. Cushion sub-assembly 10 has a main body 12 including an outer housing or casing member 14, the casing member 14 having an outer cylindrical surface 16 and an inner cylindrical surface 18, and which together with a bottom surface 20 and a back head 22, form an inner closed chamber 24.

The back head 22 includes a pin connection 26 in the usual form of a tapered threaded portion concentrically and integrally formed with the back head 22. Disposed within the main body 12 is a piston member 28 formed integrally with a cylindrical shaft 30 which projects downwardly through a circular opening 32 in the bottom surface 20, as well as through a circular opening 34 in a connecting piston seal plate 36. Within a lower end 38 of the shaft 30 is formed a box connector 40 formed by the usual tapered threaded opening.

While the present description refers to the back head 22 and the outer housing 14, it is to be appreciated that the sub-assembly cushion 10 need not be orientated in the position shown in the drawings. However, normally the pin connection 26 is connected directly to the output of the rotary drive of a drilling rig (not shown), this being referred to herein as the drive portion of the drill string. In such an arrangement, the box connector 40 is directly connected to the upper most section of the actual drill string, hereinafter referred to as the driven portion of the drill string.

Housed inside the chamber 24 are a number of components, including a plurality of elongated piston rods 42, a lower vibration damper or shock pad 44, and three upper vibration dampers or shock pads 46, 48 and 50, which are described in further detail below.

The piston member 28 is disposed within the casing member 14, and has a top surface 52 and an outer cylindrical surface 54 which is of substantially the same diameter as the inner cylindrical surface 18 of casing member 14, so as to be axially slidable within the casing member 14. In the embodiment illustrated, the shaft 30 of the piston member 28 is integrally formed with the piston member, and is of smaller diameter so as to form a lower piston surface or shoulder 56. The surface 20 defining the circular opening 32 through which the shaft 30 passes is provided with annular grooves which receive casing seals 58 and a casing wear strip 60. The casing seals 58 are used to keep grease (not shown) in the chamber 24. The piston seal plate 36 also includes a dust seal 92 which contacts the shaft 30 and thereby prevents dirt from entering inside the chamber 24.

As described above, the cushion sub-assembly 10 includes a plurality of elongated piston rods 42. The piston rods 42 are of a circular cross-section and are stepped down in diameter towards the upper and lower ends of the rods. The lower ends of the rods 42 are stepped down in diameter a first time to accommodate the lower shock pad 44, and then again so as to be accommodated within the axially extending and correspondingly shaped bores 62 in the lower surface 20 of the casing member 14. Likewise, the upper ends of the piston rods 42 are stepped down first to accommodate three shock pads 46, 48 and 50 and to be received within axially extending grooves 64 formed in the back head 22, and then again to receive rod seals or caps 66, which are placed on the upper ends of the piston rods 42 to prevent movement thereof.

The piston rods 42 extend the full length of the chamber 24, and run inside bores 68 which extend axially through the piston member 28. The purpose of the piston rods 42 is to prevent relative rotation of the casing member 14 and piston member 28, while permitting axial movement of the piston member 28 relative to the casing member 14.

The fact that the piston rods 42 run inside the piston member 28 contributes to reduced vibration, as described in further detail below, but also ensures that the rods 42 and the piston member 28 are the only major components which require re-working/replacement when the cushion sub-assembly is at the end of its useful working life. Clearly, the refurbishment of the cushion sub-assembly 10 requires only the boring out of the piston member bores 68, and replacing of the piston rods 42 with rods of larger diameter which correspond with the diameter of the newly formed bores 68. The commercial benefits of using a cushion sub-assembly 10 which can be quickly, easily and inexpensively refurbished to a state that is suitable for re-use are clearly apparent.

The piston member 28 is hollow so as to define an internal passageway 70 axially therethrough, the passageway 70 extending through the shaft 30 of the piston as well so as to be in fluid communication with the interior of a driven portion of the drill string connected by way of the box connector 40 to the piston member. The pin connection 26 of the back head 22 also has an internal passageway 72 extending therethrough so as to communicate with the section of a drill string which forms the drive portion, normally the rotary drive (not shown), connected to casing 14 of the cushion sub-assembly 10 by way of the back head 22.

A cylindrical sleeve member or air nozzle 74 has an upper end thereof disposed within a lower portion of the internal passageway 72 of the back head 22 and a lower end thereof disposed within an upper portion of the passageway 70 of the piston member 28, the air nozzle 74 thus placing the internal passageway 72 in fluid communication with the internal passageway 70. Accordingly fluid is free to flow through the cushion sub-assembly 10 from an upper driven member of the drill string to a lower driven member. The air nozzle 74 has a radially projecting annular flange 76 encircling its upper end. The flange 76 is retained against a shoulder 78 formed within an enlarged lower portion of the internal passageway 72 in the back head 22 by way of a retaining ring 80.

Two o-rings 82 are located above the flange 76 so to isolate the cylinder chamber 24 from the internal passageway 72. At the upper end of the internal passageway 70 in the piston member there is also provided a plurality of annular grooves, the upper one of which contains a piston wear strip 84, and the others being piston seals 86, to isolate the cylinder chamber 24 from the internal passageway 72.

Located in the upper end of cylinder chamber 24 are three annular shaped piston shock pads 46, 48 and 50, which prevent metal to metal contact between the top surface 52 of the piston member 28 and the back head 22. Located in the lower end of cylinder chamber 24 is a single annular shaped piston shock pad 44, which sits above surface 20 of the casing member 14 and prevents metal to metal contact between the shoulder 56 of the piston member 28 and the surface 20. The shock pads serve to cushion axial vibration and may be formed of an elastomeric type material, such as a polyurethane.

The three upper shock pads have different grade strengths. The lowest pad 46 is thick but has the lowest strength of the three pads, the middle pad 48 is of the same thickness but with increased strength, and the top pad 50 is the thinnest but the strongest. The pad at the lower end of the chamber 24 is of the same thickness as pad 46 and 48 but of the same strength as pad 50. It has been found that in arranging the shock pads in layers of different size and strength as illustrated, as well as having the piston rods 42 run inside the piston member 28 as described above, allows axial vibration to be significantly decreased because force is absorbed across all three pads, and the final pad being the strongest ensures that minimal vibration is carried up through to the rotary head. The rod seals 66, in cushioning the upper ends of the piston rods 42, may also provide a form of torsional vibration damping.

As the piston member 28 approaches its lower extreme position, its downward movement relative to the casing member 14 is cushioned by the lower shock pad 44 and then as it approaches its higher extreme position, its upward movement relative to the casing member 14 is cushioned by the upper shock pads 46, 48 and 50. It can be seen, therefore, that the piston member 28 has relatively free or floating movement within a major portion of its axial travel intermediate the lower surface of shock pad 46 and the upper surface of shock pad 44, while being prevented from axial rotation relative to the casing member 14 by way of the piston rods 42. The extent of movement of the piston member 28 is approximately 100 mm.

The back head 22 and piston seal cap 36 can be attached to the casing member 14 using any suitable connection means such as threaded bolt connections. The same applies to the connection between the retaining ring 80 and air nozzle 74. The reference numeral 90 is used in connection with all of the bolts used. It is to be understood however that the present invention is not intended to be limited to a particular type of connection means. Prior to bolting, the chamber 24 is filled with grease (not shown), and where re-greasing is required, there is also provided a plug 88 extending through the side wall of casing member 14.

Figure 4:
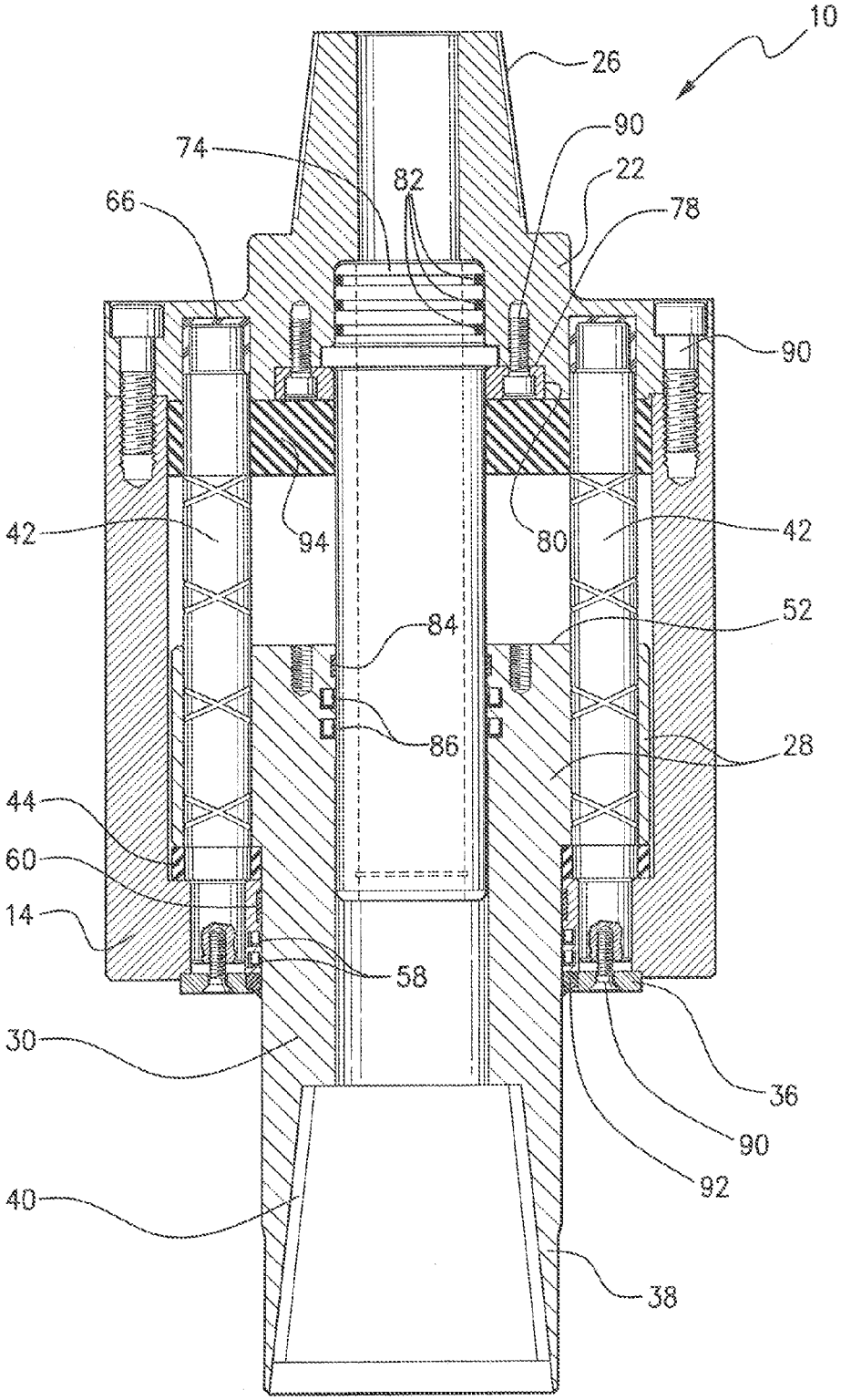
FIG. 4 illustrates a cross-sectional view of the cushion sub-assembly of a second embodiment of a cushion sub-assembly.

FIG. 4 illustrates a second embodiment of the cushion sub-assembly 10. In this embodiment, there is a single annular shaped piston shock pad 94 as an alternative to three annular shaped piston shock pads 46, 48 and 50 illustrated in previous embodiments. Also, in this embodiment, the plug 88 (not shown on FIG. 4) is disposed towards an upper section of the cushion sub-assembly 10. Furthermore, in this embodiment, piston wear strip 84 is disposed below the top surface 52 of the piston member 28.

The cushion sub-assembly 10 provides a means of significantly reducing vibrations resulting from downhole hammer type drilling, which are typically carried up through to the rotary head and which may otherwise cause significant damage. During testing of various embodiments, the cushion sub-assembly 10 has been found to decrease axial vibrations by a factor of three to four.

The invention further provides a cushion sub-assembly that is of a more efficient design than previously known sub-assemblies in that there are fewer parts, and the arrangement of parts, for example the fact that the piston rods 42 run inside the piston member 28, means that fewer parts (such as the casing member 14 for example) require replacement. The design allows those parts which do become worn through use, to be easily refurbished or replaced within minimal time and with minimal expense.

Further advantages and improvements may be made to the present invention without deviating from its scope. Although the invention has been shown and described in what is conceived to be the most practical embodiment, it is recognized that departures may be made therefrom within the scope and spirit of the invention, which is not to be limited to the details disclosed herein but is to be accorded the full scope of the claims so as to embrace any and all equivalent devices and apparatus.

The claims defining the invention are as follows:

1. A cushion sub-assembly for connection to a drill string to absorb vibrations in the drill string, the cushion sub-assembly including:

a main body defining a chamber therein;

a piston member disposed within the chamber capable of axial movement at least partially within the chamber between a first and second position;

at least one axially extending piston rod disposed inside a respective axial bore of the piston member, the at least one piston rod preventing relative rotation between the piston member and the main body while permitting axial movement of the piston member between the first and second positions; and a vibration absorbing means at opposite ends of the chamber for engagement by the piston member when in either of the first or second positions for absorbing axial vibrations;

the configuration of the at least one piston rod inside the piston member, and engagement of the piston member with the vibration absorbing means serving to minimize transmission of axial vibrations between the piston member and the main body, wherein the upper end of the at least one axially extending piston rod is constrained by a cap to prevent movement thereof, wherein the vibration absorbing means at the upper end of the chamber comprises three pads of elastomeric material, each one of the three pads of elastomeric material having a different grade strength, and wherein the lower-most pad of elastomeric material has a first thickness and has a first, grade strength, the middle pad has a second thickness substantially equal to the first thickness and a second grade strength substantially greater than the first grade strength, and the upper-most pad of elastomeric material has a third thickness substantially thinner than the first thickness and has a third grade strength substantially greater than the second grade strength.

2. A cushion sub-assembly according to claim 1, wherein the piston member includes a piston shaft formed integrally therewith, the piston shaft being of a reduced diameter.

3. A cushion sub-assembly according to claim 2, wherein said respective axial bore is disposed radially outwardly of the piston shaft.

4. A cushion sub-assembly according to claim 3, wherein a plurality of said at least one axially extending piston rods are disposed inside respective axial bores and said respective bores are equispaced on a circumferential path through said piston member.

5. A cushion sub-assembly according to claim 2, wherein the main body includes a casing member defining the chamber and a back head mounted on the casing member at an upper end thereof, the back head including a first connection means for rigid connection to a driving portion of the drill string and the piston shaft includes a second connection means for rigid connection to a driven portion of the drill string.

6. A cushion sub-assembly according to claim 2, wherein the piston member is hollow so as to define a first internal passageway axially therethrough, the first internal passageway further extending through the shaft of the piston and wherein the first internal passageway is in fluid communication with an interior of a driven portion of the drill string connected to the piston member.

7. A cushion sub-assembly according to claim 6, wherein the fluid is air.

8. A cushion sub-assembly according claim 6, wherein the back head includes a second internal passageway extending therethrough and wherein the second internal passageway is in fluid communication with a drive portion of the drill string.

9. A cushion sub--assembly according to claim 8, further including a fluid nozzle having an first end thereof disposed within a lower portion of the second internal passageway, and a second end thereof disposed within an upper portion of the first internal passageway, wherein the fluid nozzle allows the first internal passageway and the second internal passageway to be in fluid communication with each other, such that fluid is allowed to flow through the cushion sub-assembly from the drive portion of the drill string to the driven portion of the drill string.

10. A cushion sub-assembly according to claim 1, wherein the main body includes a casing member defining the chamber and a back head mounted on the casing member at an upper end thereof, the back head including a first connection means for rigid connection to a driving portion of the drill string.

11. A cushion sub-assembly according to claim 1, wherein the first position of the piston member corresponds with an upper end of the main body, and the second position of the piston member corresponds with a lower end of the main body.

12. A cushion sub-assembly according to claim 1, wherein the vibration absorbing means includes at least one pad of elastomeric material.

13. A cushion sub-assembly according to claim 1, wherein a plurality of said at least one axially extending piston rod disposed inside respective axial bores is provided.

14. A cushion sub-assembly according to claim 13, wherein said respective bores are equispaced on a circumferential path through said piston member.

15. A cushion sub-assembly according to claim 1, wherein the opposing ends of said at least one axially extending piston rods extend through said vibration absorbing means at opposite ends of said chamber.

* * * * *